US009630683B1

(12) United States Patent
Yost

(10) Patent No.: US 9,630,683 B1
(45) Date of Patent: Apr. 25, 2017

(54) ROPE STORAGE SYSTEM

(71) Applicant: Verl Yost, Wendell, NC (US)

(72) Inventor: Verl Yost, Wendell, NC (US)

( * ) Notice: Subject to any disclaimer, the term of this patent is extended or adjusted under 35 U.S.C. 154(b) by 0 days.

(21) Appl. No.: 15/286,746

(22) Filed: Oct. 6, 2016

Related U.S. Application Data

(63) Continuation-in-part of application No. 14/932,559, filed on Nov. 4, 2015.

(51) Int. Cl.
*B63B 21/20* (2006.01)
*B63B 21/04* (2006.01)

(52) U.S. Cl.
CPC ..... *B63B 21/20* (2013.01); *B63B 21/045* (2013.01)

(58) Field of Classification Search
CPC ..... B63B 21/20; B63B 21/045
USPC ..... 114/218
See application file for complete search history.

(56) References Cited

U.S. PATENT DOCUMENTS 2,915,259 A * 12/1959 Force ..... B63B 35/816 114/254
3,315,914 A * 4/1967 Turner ..... B61B 12/10 242/390.1
4,133,496 A * 1/1979 Zetah ..... B63B 35/815 114/254
4,969,610 A * 11/1990 Taylor ..... B63B 35/816 114/254
D334,960 S 4/1993 Goodman
6,474,588 B2 * 11/2002 Valverde ..... B63B 35/816 114/254
7,841,287 B2 * 11/2010 Wingate ..... B60P 7/0823 114/230.2
2005/0029381 A1 * 2/2005 Lamonica ..... B65H 75/4431 242/385.4
2008/0054118 A1 * 3/2008 Czajkowski ..... B63B 35/815 242/395
2008/0257999 A1 * 10/2008 Wingate ..... B60P 7/0823 242/376

* cited by examiner

*Primary Examiner* — Lars A Olson
*Assistant Examiner* — Jovon Hayes

(57) ABSTRACT

A nautical cleat engagement device provides secure engagement to a nautical cleat without directly tying a rope or line to the nautical cleat. The device includes a housing which may be incorporated into or coupled to whatever a user might wish to secure to a cleat. An opening extends into a bottom surface of the housing. The opening is elongated for receiving a horn cleat through the opening. The housing has a cavity in alignment with the opening permitting rotation of the horn cleat within the housing into a locking position within the cavity. A locking pin extends through the housing into the cavity to inhibit rotation of the horn cleat from the locking position.

7 Claims, 3 Drawing Sheets

ROPE STORAGE SYSTEM

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to engagement devices and more particularly pertains to a new engagement device for providing secure engagement to a nautical cleat without directly tying a rope or line to the nautical cleat.

BRIEF SUMMARY OF THE INVENTION

An embodiment of the disclosure meets the needs presented above by generally comprising a housing. An opening extends into a bottom surface of the housing. The opening is elongated for receiving a horn cleat through the opening. The housing has a cavity in alignment with the opening permitting rotation of the horn cleat within the housing into a locking position within the cavity. A locking pin extends through the housing into the cavity to inhibit rotation of the horn cleat from the locking position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
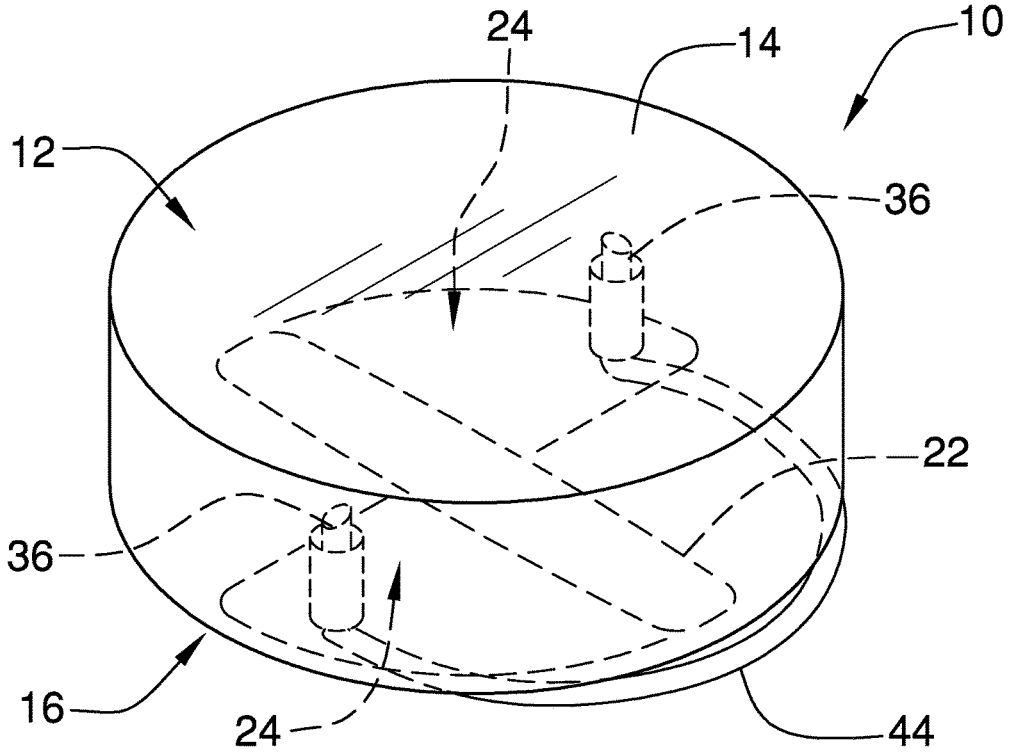
FIG. 1 is a top front side perspective view of a nautical cleat engagement device according to an embodiment of the disclosure.
Figure 2:
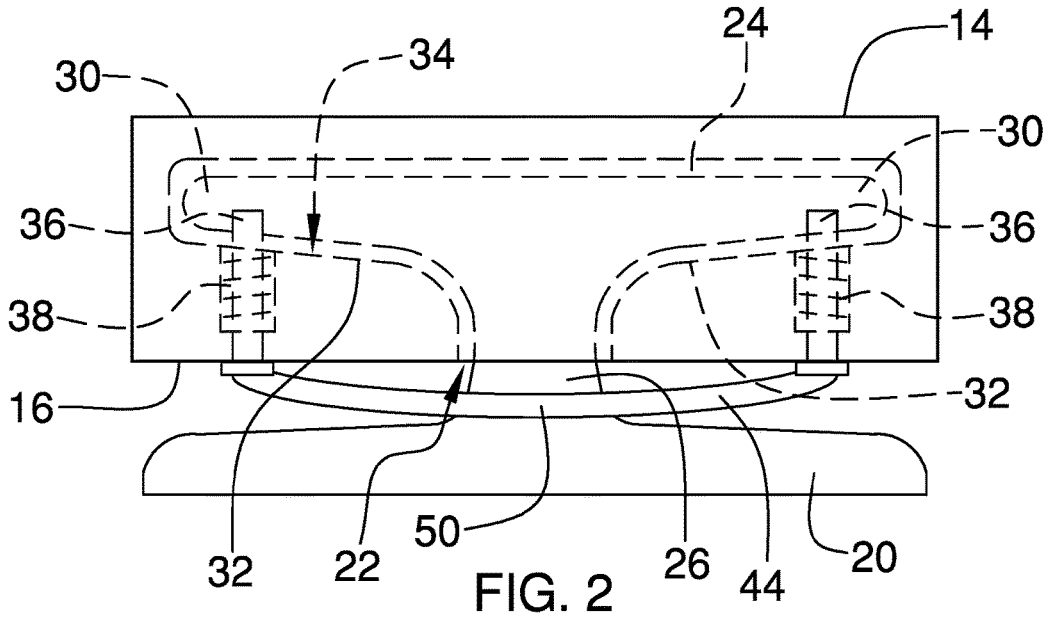
FIG. 2 is a front view of an embodiment of the disclosure.
Figure 3:
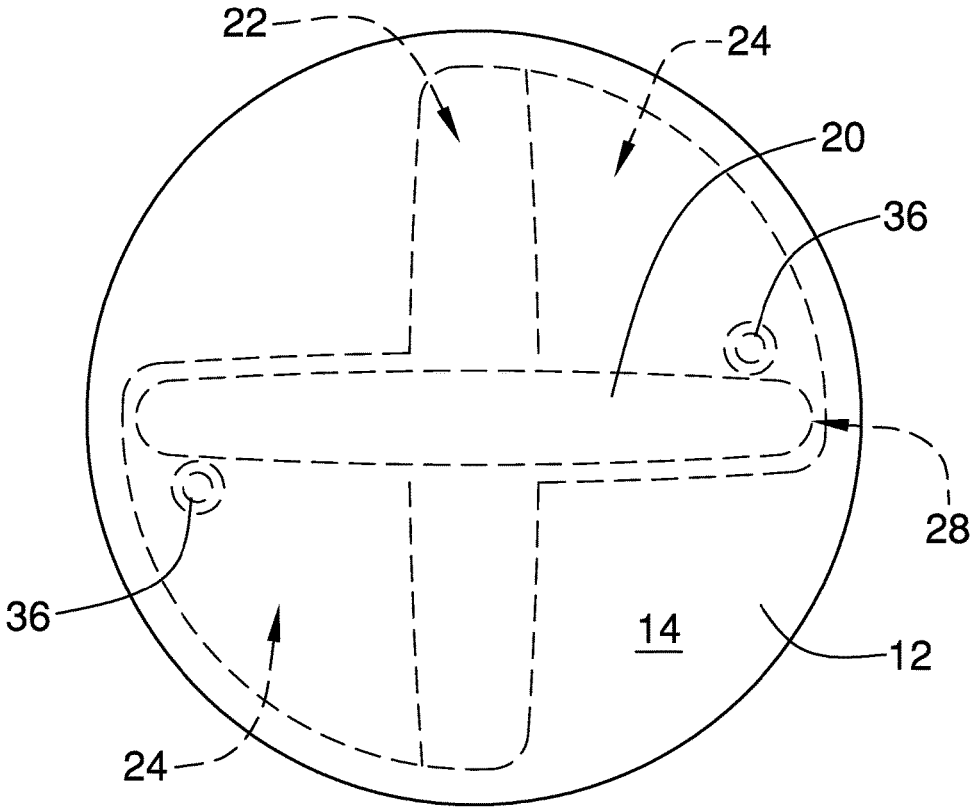
FIG. 3 is a top view of an embodiment of the disclosure.
Figure 4:
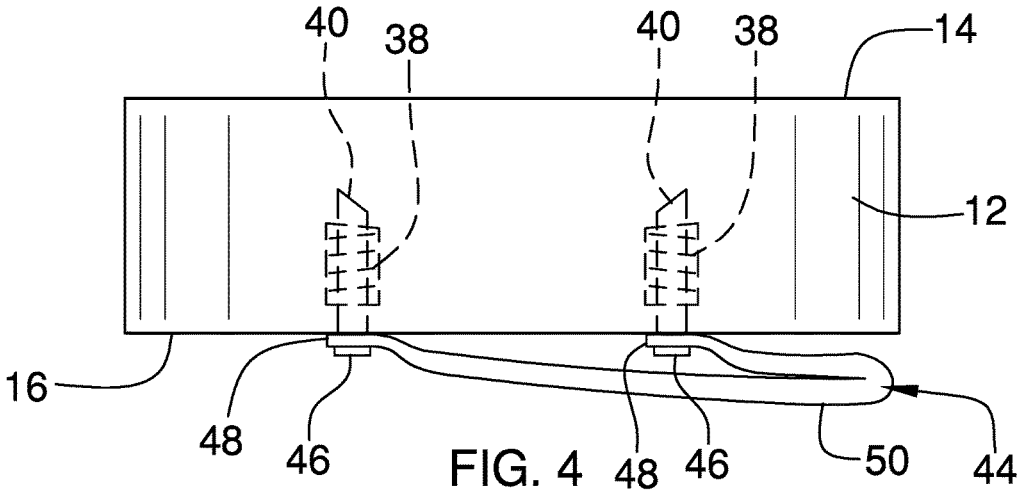
FIG. 4 is a side view of an embodiment of the disclosure.
Figure 5:
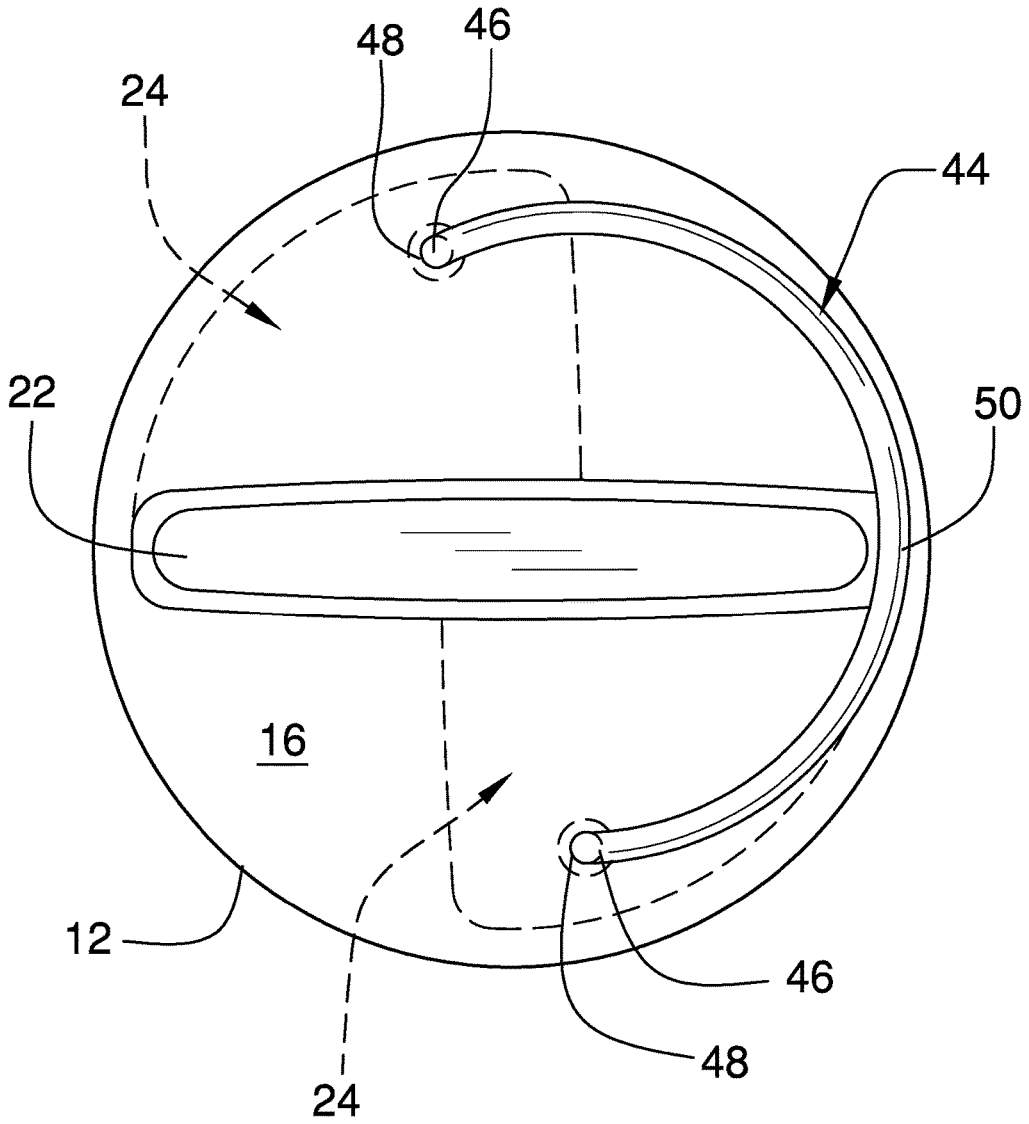
FIG. 5 is a bottom view of an embodiment of the disclosure.

With reference now to the drawings, and in particular to FIGS. 1 through 5 thereof, a new engagement device embodying the principles and concepts of an embodiment of the disclosure and generally designated by the reference numeral 10 will be described.

As best illustrated in FIGS. 1 through 5, the nautical cleat engagement device 10 generally comprises a housing 12 having a top surface 14 and a bottom surface 16. The top surface 14 may be incorporated into various structures allowing the housing 12 to be coupled to or engaged by ropes, lines, or any structure or apparatus one might wish to attach to a nautical cleat, particularly a horn cleat 20. An opening 22 extends into the bottom surface 16 of the housing 12. The opening 22 is elongated wherein the opening 22 is configured for receiving the horn cleat 20 therethrough. The housing 12 is structured to include a cavity 24 therein in alignment with the opening 22. The cavity 24 is configured for permitting rotation of the horn cleat 20 within the housing 12 while a spar 26 of the horn cleat 20 is extended through the opening 22. The cavity 24 extends laterally into the housing 12 relative to the opening 22 such that the cavity 24 is configured for twisting or rotation of the housing 12 for positioning the horn cleat 20 in a locking position 28 within the cavity 24 preventing a pair of horns 30 of the horn cleat 20 from passing back through the opening 22. An interior surface 32 of the housing 12 defining a side 34 of the cavity 24 adjacent to the bottom surface 16 is sloped wherein the interior surface 32 is configured for urging the horn cleat 20 towards the top surface 14 when the housing 12 is rotated towards the locking position 28.

Each of a pair of locking pins 36 extends through the housing 12. Each locking pin 36 extends into the cavity 24 wherein each locking pin 36 is configured to inhibit rotation of the horn cleat 20 from the locking position 28. Each locking pin 36 is biased to extend into the cavity 24 by a biasing member 38 such as a spring or the like. The pair of locking pins 36 is symmetrically positioned about a central axis of the opening 22. An interior end 40 of each locking pin 36 is sloped to retract the locking pin 36 by rotation of the horn cleat 20 within the cavity 24 from an initially inserted position towards the locking position 28.

A release arm 44 is coupled to the housing 12. The release arm 44 is coupled to an exterior end 46 of each locking pin 36. Manipulation of the release arm 44 urges the locking pins 36 out of the cavity 24 wherein the release arm 44 is configured for facilitating free rotation of the horn cleat 20 within the cavity 24 to permit alignment of the horn cleat 20 with the opening 22 to allow removal of the horn cleat 20 from the cavity 24 through the opening 22. The release arm 44 is U-shaped and each of a pair of opposite ends 48 of the release arm 44 is coupled to an associated one of the pair of locking pins 36. The release arm 44 is bent or curved in the manner of a pry bar or the like such that a medial section 50 of the release arm 44 may be urged towards the housing 12 resulting in retraction of the locking pins 36 out of the cavity 24. The locking pins 36 are positioned to extend through the bottom surface 16 such that the release arm 44 is positioned in a space between the bottom surface 16 and a surface to which the horn cleat 20 is attached.

In use, the horn cleat 20 is inserted through the opening 22 and the housing 12 is rotated until the locking pins 36 retract and extend back into the cavity 24 to secure the horn cleat 20 within the housing 12. Thus, the housing 12, and any implement or apparatus incorporated, integrated, or otherwise coupled to the housing 12, is secured to the horn cleat 20. The release arm 44 is manipulated to disengage the locking pins 36 allowing the horn cleat 20 to be rotated back into alignment with the opening 22 for removal of the housing 12 from the horn cleat 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A nautical cleat engagement device comprising:

a housing having a top surface and a bottom surface;

an opening extending into said bottom surface of said housing, said opening being elongated wherein said opening is configured for receiving a horn cleat therethrough;

said housing being structured to include a cavity therein in alignment with said opening, said cavity being configured for permitting rotation of the horn cleat within said housing while a spar of the horn cleat is extended through said opening, said cavity extending laterally into said housing relative to said opening such that said cavity is configured for positioning the horn cleat in a locking position within said cavity preventing a pair of horns of the horn cleat from passing back through said opening; and a locking pin, said locking pin extending through said housing, said locking pin extending into said cavity wherein said locking pin is configured to inhibit rotation of the horn cleat from the locking position.

2. The device of claim 1, further comprising an interior surface of said housing defining a side of said cavity adjacent to said bottom surface being sloped wherein said interior surface is configured for urging said horn cleat towards said top surface when said housing is rotated towards said locking position.

3. The device of claim 1, further comprising said locking pin being biased to extend into said cavity.

4. The device of claim 3, further comprising a release arm coupled to said housing, said release arm being coupled to said locking pin such that manipulation of said release arm urges said locking pin out of said cavity wherein said release arm is configured for facilitating free rotation of the horn cleat within said cavity to permit alignment of the horn cleat with said opening to allow removal of the horn cleat from said cavity through said opening.

5. The device of claim 4, further comprising said locking pin being one of a pair of locking pins, said pair of locking pins being symmetrically positioned about a central axis of said opening.

6. The device of claim 5, further comprising said release arm being U-shaped, each of a pair of opposite ends of said release arm being coupled to an associated one of said pair of locking pins.

7. A nautical cleat engagement device comprising:

a housing having a top surface and a bottom surface;

an opening extending into said bottom surface of said housing, said opening being elongated wherein said opening is configured for receiving a horn cleat therethrough;

said housing being structured to include a cavity therein in alignment with said opening, said cavity being configured for permitting rotation of the horn cleat within said housing while a spar of the horn cleat is extended through said opening, said cavity extending laterally into said housing relative to said opening such that said cavity is configured for positioning the horn cleat in a locking position within said cavity preventing a pair of horns of the horn cleat from passing back through said opening, an interior surface of said housing defining a side of said cavity adjacent to said bottom surface being sloped wherein said interior surface is configured for urging said horn cleat towards said top surface when said housing is rotated towards said locking position;

a pair of locking pins, said pair of locking pins being symmetrically positioned about a central axis of said opening, each said locking pin extending through said housing, each said locking pin extending into said cavity wherein each said locking pin is configured to inhibit rotation of the horn cleat from the locking position, each said locking pin being biased to extend into said cavity; and a release arm coupled to said housing, said release arm being coupled to said locking pin such that manipulation of said release arm urges said locking pin out of said cavity wherein said release arm is configured for facilitating free rotation of the horn cleat within said cavity to permit alignment of the horn cleat with said opening to allow removal of the horn cleat from said cavity through said opening, said release arm being U-shaped, each of a pair of opposite ends of said release arm being coupled to an associated one of said pair of locking pins.

* * * * *